United States Patent [19]

Andrews

[11] 4,077,356

[45] Mar. 7, 1978

[54] PAINT SPRAYING MACHINE

[75] Inventor: Joseph J. Andrews, Green Hill Farms, Pa.

[73] Assignee: Keystone Automated Equipment Co., Philadelphia, Pa.

[21] Appl. No.: 746,140

[22] Filed: Nov. 30, 1976

[51] Int. Cl.[2] ..... B05B 15/04; B05C 5/02

[52] U.S. Cl. ..... 118/301; 118/313; 118/320

[58] Field of Search ..... 118/1, 4, 9, 301, 313, 118/320, 323, 406, 416; 192/116.5; 222/52

[56] References Cited

U.S. PATENT DOCUMENTS 1,700,697 1/1929 Draper ..... 118/320 X

*Primary Examiner*—Louis K. Rimrodt

*Attorney, Agent, or Firm*—Frailey & Ratner

[57] ABSTRACT

An automatic paint machine for painting cylindrically contoured objects. The paint machine includes a pair of housing members which are movable in a longitudinal direction for positionally mounting the cylindrical objects in a predetermined location. A cylindrical object to be painted is mounted in rotational displacement with respect to a multiplicity of rollers which extend from each of the housing members. Rotation of the rollers results in a corresponding counterrotation of the cylindrical object being painted. A series of spray nozzles are mounted on the machine to provide a spray of paint unto the surface of the object. A plurality of shield members are positioned adjacent a segmental portion of an outer surface of the object being painted. The shields intersect the path of paint being sprayed from particular spray nozzles to divide the object surface into zones and producing a sharp delineation of color between one zone and another. Additionally, the automatic paint machine includes an ejection mechanism for removing the cylindrical object from the machine subsequent to the painting operation being completed.

22 Claims, 6 Drawing Figures

PAINT SPRAYING MACHINE

BACKGROUND OF THE INVENTION

A. Field of the Invention

This invention pertains to paint machines. In particular this invention relates to automatic painting of objects having a cylindrical contour. More in particular, this invention relates to an automatic painting machine for painting delineated color zones on the surface of a cylindrical object and then removing the object from the painting machine subsequent to the painting operation.

B. Prior Art

Painting machines for automatically painting objects are well known in the art. However, in some of these prior painting systems, the object to be painted was manually sprayed with paint. Such prior systems did not permit the object to be painted with sharp color delineated zones. Thus, in such prior systems, a number of coatings were necessarily applied to achieve various color zones. This had the effect of increasing the cost of the painting operation.

In other prior systems, the painting machine provided for the mounting of the object on the system. However, in some prior systems, the paint machine was not adjustable to allow for different sized objects to be painted. Thus, such prior systems did not provide for versatility in accepting differently sized objects for painting and reduced the painting capability of such prior systems.

In other prior painting systems, shield members have been used in order to block paint from a particular zonal area of the object being painted. However, in such prior systems, the paint shields were not adjustable in a particular direction to allow for different widths of colored zones on the object to be painted. This had the effect of reducing the overall capability of such systems in painting objects where varying color zone widths were needed.

In still other prior systems, the object after having been painted was removed manually. In such prior systems, no mechanism was provided for automatic ejection of the object subsequent to the painting operation. Thus, there was a loss in operating time for the system when the object had to be removed and a new object inserted into such prior painting systems.

In other prior paint systems, the main operating components were in the path of paint being sprayed on the objects to be painted. This caused excessive system nonoperation time when such components had to be cleaned after paint fouling. In such prior systems, the lack of shielding from the paint being sprayed increased the cost of the overall painting operation.

SUMMARY OF THE INVENTION

An automatic paint machine for painting an object which includes a pair of longitudinally displaceable housing members for positionally mounting the paint machine in a predetermined location. The paint machine includes a mechanism for spraying paint on an outer surface of the object and a further means for delineating zones on the surface of the object. The mechanism for delineating the zones directs the spray paint from the spray paint mechanism to a predetermined zone on the surface of the object being painted. Housing displacement means is provided for longitudinally displacing the housing members each with respect to the other to accommodate differing sized objects. Further, the automatic paint machine includes a mechanism for ejecting the object from the positionally mounting on the housing members subsequent to the painting operation.

DETAILED DESCRIPTION

Figure 1:
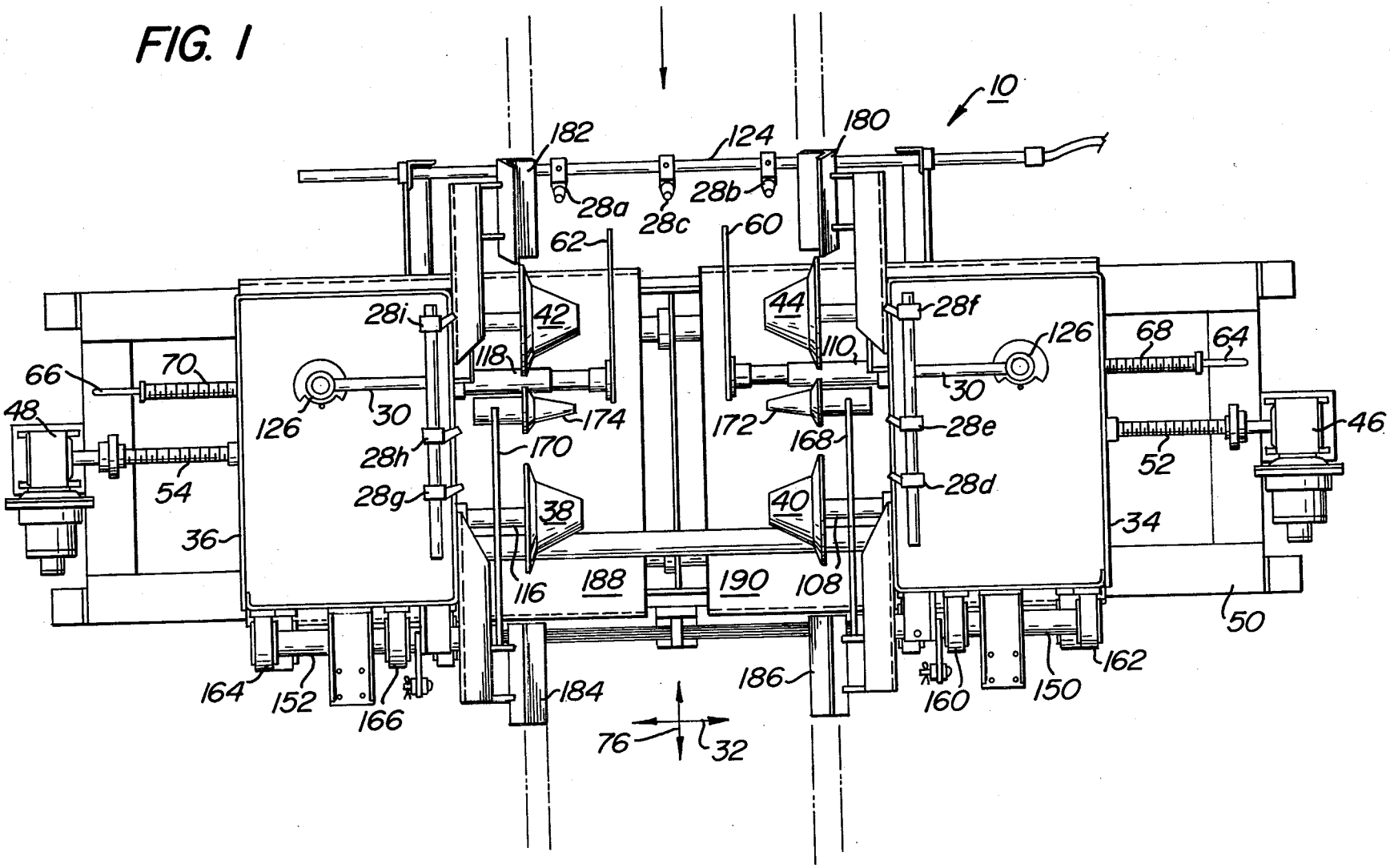
FIG. 1 is a plane view of the automatic paint machine.
Figure 2:
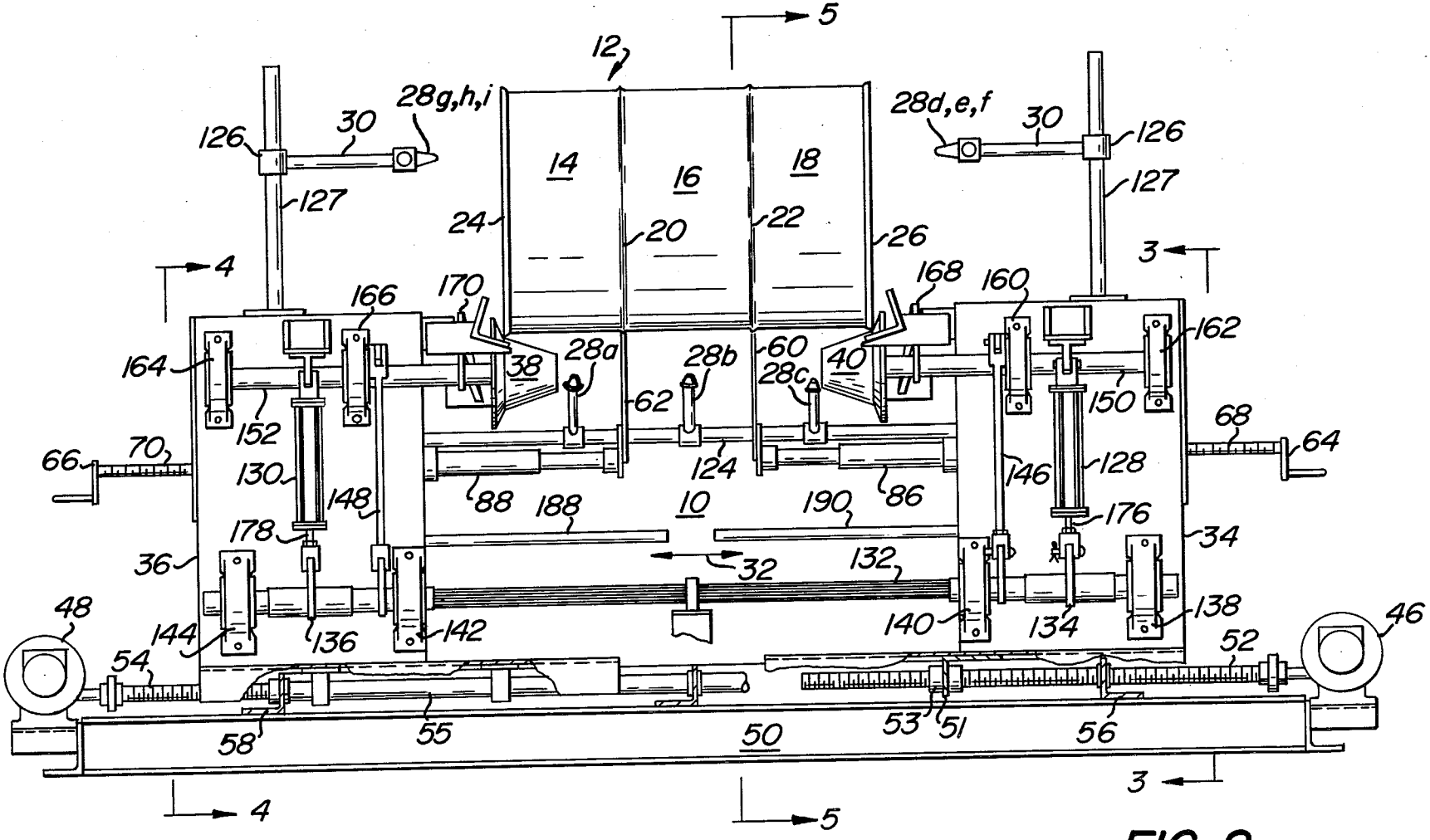
FIG. 2 is a frontal view of the automatic paint machine.

Referring now to FIGS. 1 and 2, there is shown improved paint sprayer 10 for painting barrels 12 or other objects having a non-planar geometric contour. In overall concept, paint sprayer 10 may be utilized for painting barrels 12 with stripes of differently colored paint or otherwise providing for discrete painting areas on barrels 12 which have sharp delineation of color. For purposes of illustration, FIG. 2 shows barrel 12 mounted on paint sprayer 10 and provides for three zones 14, 16 and 18 where the zones are divided by zone boundary lines 20 and 22. As will be shown in following paragraphs, paint sprayer 10 permits each of zones 14, 16 and 18 to be provided with an individual color. Additionally, sprayer 10 simultaneously provides for the painting of barrel end walls 24 and 26.

Initially, barrels 12 are inserted onto paint sprayer 10 in rotational displacement with respect thereto. Barrels 12 are rotationally displaced with respect to spray nozzles 28 which spray paint into respective barrel zones 14, 16 and 18 giving a sharp delineation at boundary lines 20 and 22. Concurrently, end spray units 30 emit paint onto barrel end walls 24 and 26. Upon termination of the spraying process, barrel 12 is automatically ejected from improved paint sprayer 10 and releases the unit for insertion of a next consecutive barrel 12 to be painted.

Improved paint sprayer 10 is adjusted in longitudinal direction 32 to accept barrels or other substantially cylindrical objects 12 having a predetermined width. Opposing housing frames 34 and 36 are longitudinally adjustable to provide acceptable rotational contact interface between barrels 12 and rollers 38, 40, 42 and 44 upon which they are releasably mounted. Respective air motors of a standard type 46 and 48 are rigidly secured to base frame 50 on opposing longitudinal sides thereof. Motors 46 and 48 are connected to Acme type threaded shafts 52 and 54 for rotation of the shafts responsive to actuation of the respective air motors 46 and 48.

Longitudinal displacement of housing member 34 responsive to rotation of shaft 52 is accomplished through L-flange 51 and internally threaded collar 53. Flange 51 is securely fastened to an undersurface of housing 34 and an outer peripheral surface of collar 53. Collar 53 matingly engages the Acme threads of shaft member 52 to provide the transfer of rotational displacement of shaft 52 into longitudinal displacement of housing member 34. A similar L-flange and collar is mounted to housing member 36 and shaft section 54.

L-flanges 56, 58 each having an associated collar having a through opening within which the respective shafts 52 and 54 rotate. L-flanges 56 and 58 are rigidly secured in fixed position to base frame 50 and serve as support columns as well as end stops for the displacement of housings 34, 36. Thus, actuation of air motors 46 and 48 results in an appropriate rotation of the threaded shaft sections 52 and 54 which causes movement or displacement of housing frames 34 and 36 in longitudinal direction 32. Air motors 46 and 48 are well known in the art and are manually actuated independent of each other in order that one of housing frames 34 or 36 may be movably displaced with respect to the other if so desired.

Figure 5:
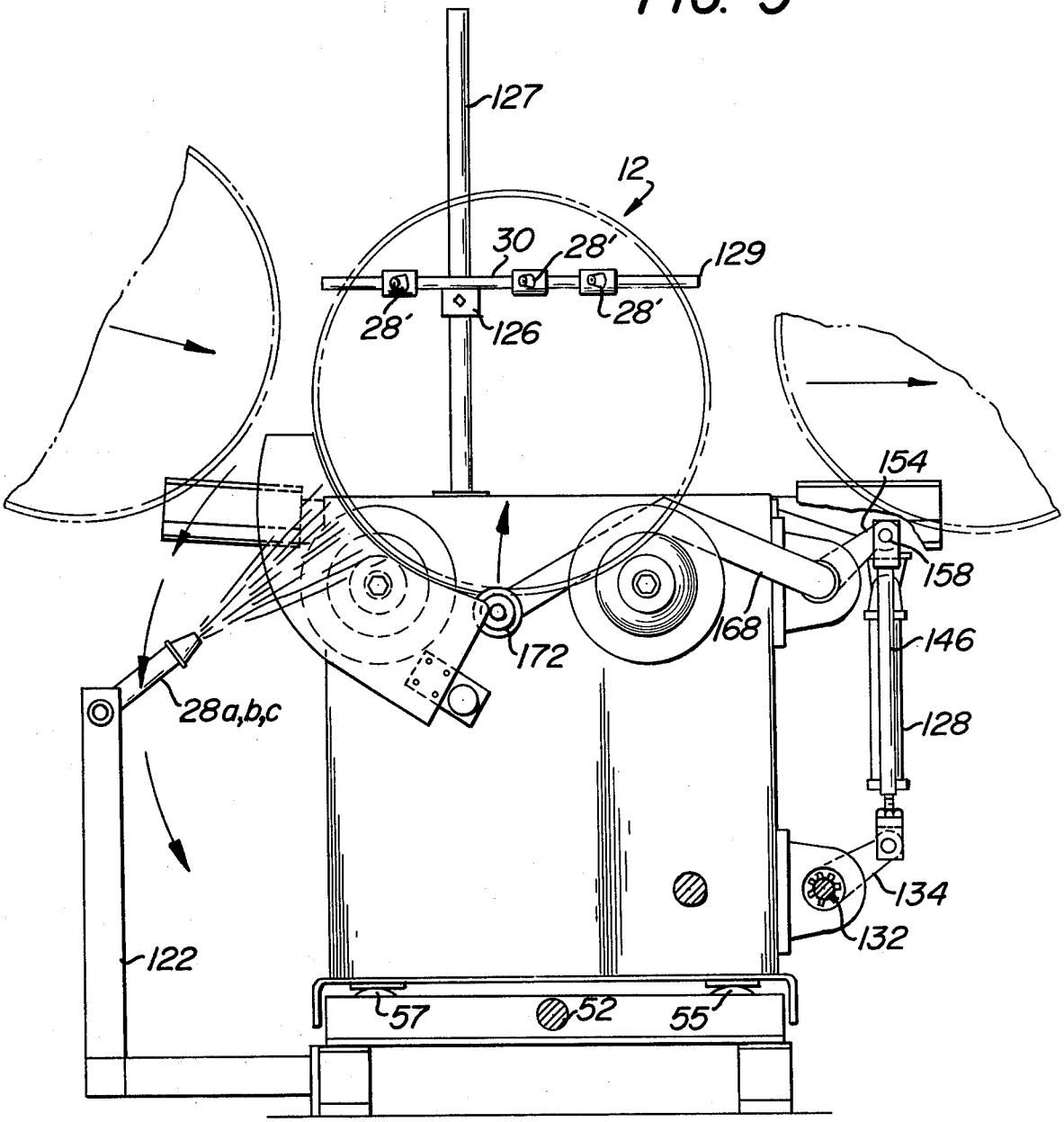
FIG. 5 is an elevational sectional view of the automatic paint machine taken along the section lines 5—5 of FIG. 2; and, FIG. 6 is a schematic diagram showing the air flow for operation of the spray nozzles and delineating the zone shields as well as the eject mechanism for the automatic paint spray machine.

Additionally, referring to FIGS. 2 and 5, it is seen that displaceable housings 34 and 36 are slideably mounted on pillar blocks 55 and 57. Blocks 55 and 57 provide tracks within which displacement occurs and support the weight of housings 34 and 36.

Referring now to FIGS. 1–4, subsequent to appropriate longitudinal adjustment housing frames 34 and 36, paint shields 60 and 62 may be individually adjusted in longitudinal direction 32 for proper delineation of barrel zones 14, 16 and 18. Adjustment of shields 60 and 62 is provided through hand cranks 64 and 66 which are adapted to be manually rotatable.

Thus, rotation of hand cranks 64 and 66 produces rotation of threaded shafts 68 and 70 which are rotatably mounted through frames 34 and 36 to provide longitudinal displacement of shields 60 and 62 respectively. In this manner, the particular width of barrel zones 14, 16 and 18 may be individually adjusted.

Figure 3:
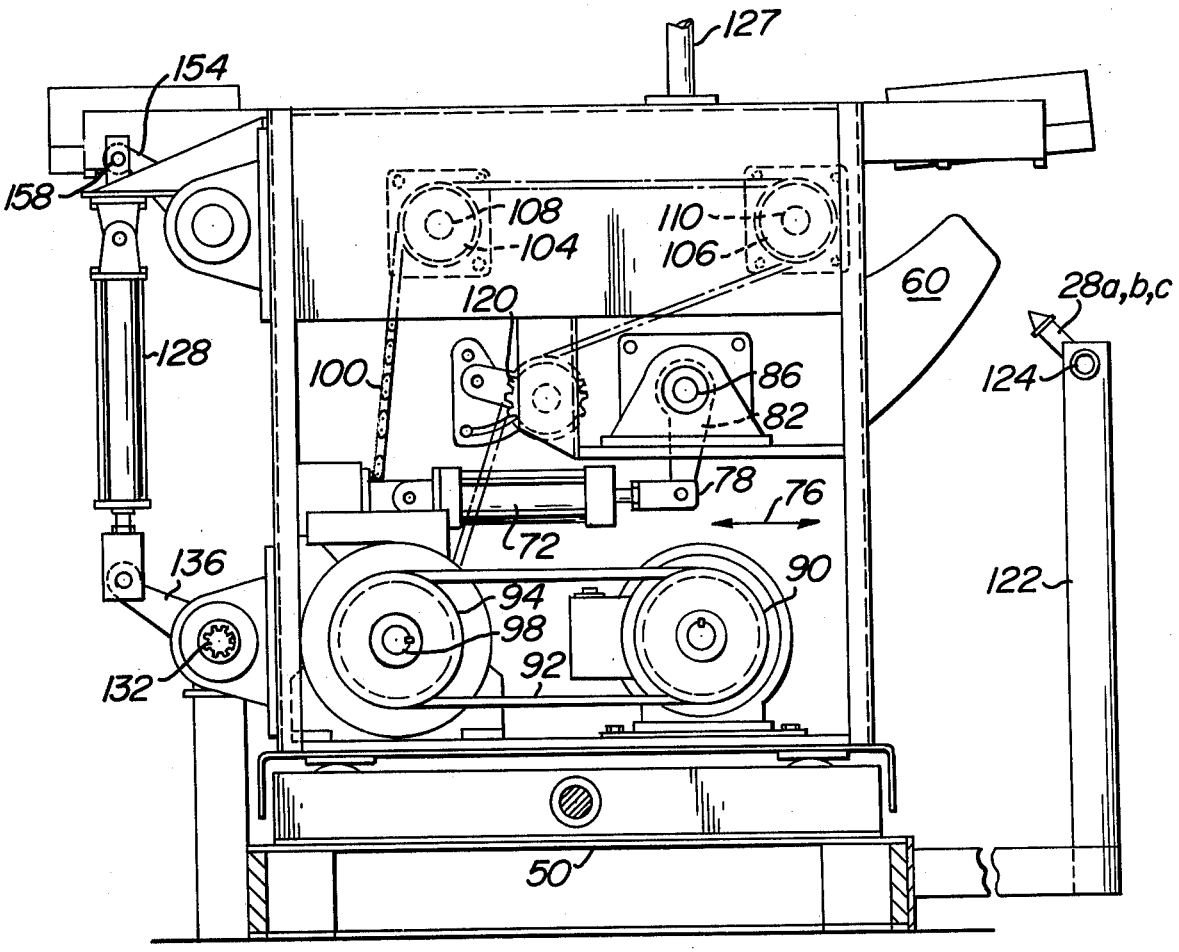
FIG. 3 is an elevantional section view of the automatic paint machine taken along the section lines 3—3 of FIG. 2.
Figure 4:
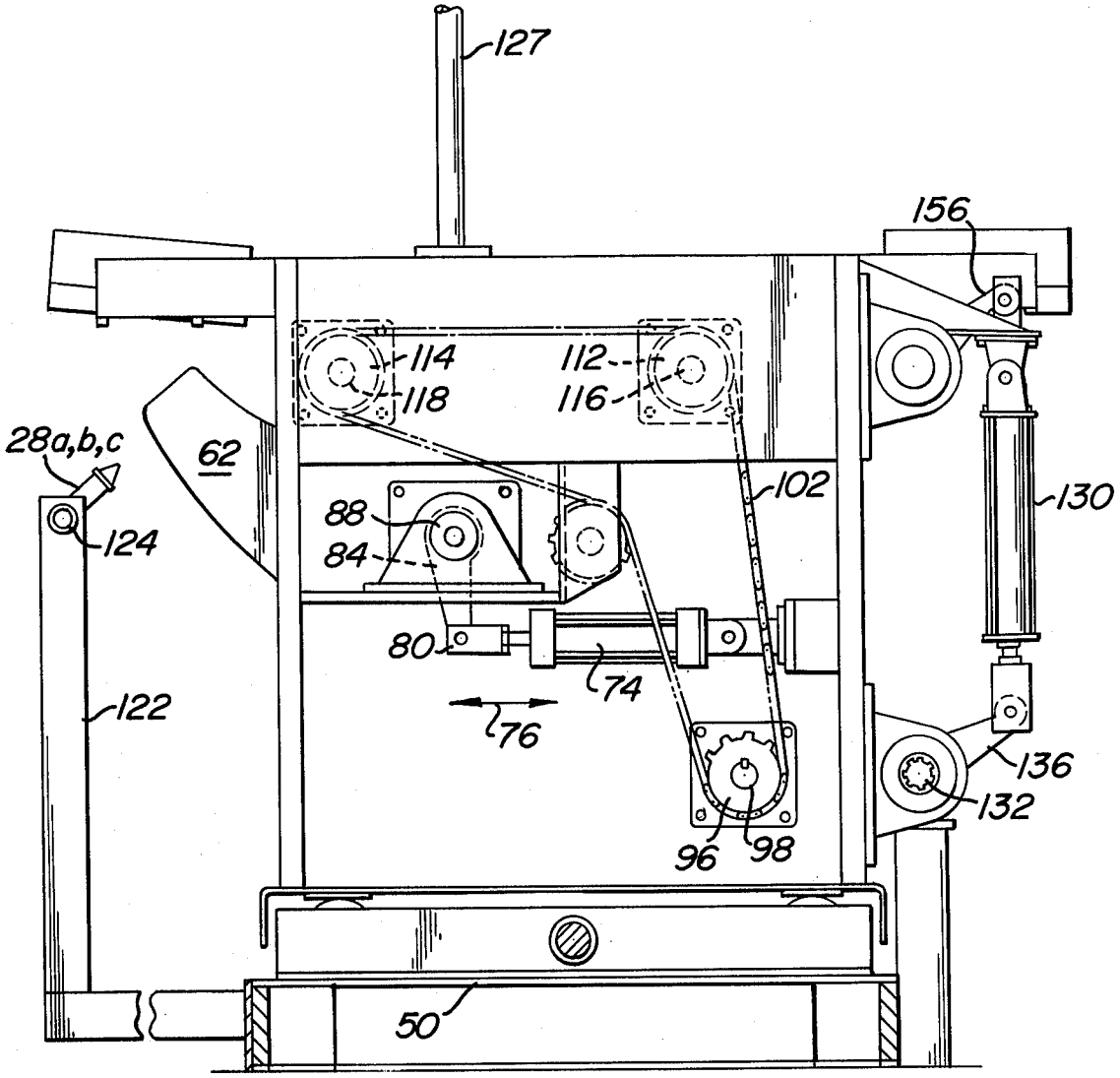
FIG. 4 is an elevational sectional view of the automatic paint machine taken along the section lines 4—4 of FIG. 2.

As is clearly seen, in FIGS. 3 and 4, shields 60 and 62 include an arcuate contour surface adapted to segmentally pass around a portion of the outer surface of barrels 12. Thus, spray nozzles 28 are essentially isolated each from the other within a zone defined by paint shields 60 and 62. In this manner, shields 60 and 62 provide for the delineation of boundary lines 20 and 22 on the lateral surface of barrels 12 when spray nozzles 28 are actuated.

As has been stated, shields 60 and 62 pass around a segmental portion of the lateral surface of barrels 12 and thus may block or otherwise intersect the path of a barrel 12 being mounted on improved paint sprayer 10 as is seen in FIG. 5. In order to permit a clear path for injection of barrel 12 from paint sprayer 10, shields 60 and 62 may be rotated in an appropriate manner to provide for barrel 12 injection.

Referring now to FIGS. 3 and 4, there is seen shield air cylinders 72 and 74 mounted respectively within housing frames 34 and 36. Actuation of air cylinders 72 and 74 provide for displacement of cylinder head members 78 and 80. Heads 78 and 80 are pivotally connected to bell crank extension shafts 82 and 84 which are in turn fixedly mounted to shield shafts 86 and 88.

Thus, motion of or actuation of air cylinders 72 and 74 in transverse direction 76 has a resulting rotational drive effect to shaft members 86 and 88. Each of paint shields 60 and 62 are mounted to an end portion of shield shafts 86 and 88 in rigid securement thereto and are responsively driven in a rotational direction corresponding to actuation of air cylinders 72 and 74.

In this manner, shield members 60 and 62 may be combinationally adjusted in longitudinal direction 32 for delineation of color zones 14, 16 and 18 and further rotationally moved about an axis defined by the extension of shafts 86 and 88 to provide a clear path for barrels 12 upon insertion to paint sprayer 10.

In order to provide for an even spray of paint within barrel zones 14, 16 and 18, barrel 12 after positional placement on rollers 38, 40, 42 and 44 are rotationally displaced with respect to fixedly positioned spray nozzles 28. Referring now to FIGS. 3 and 4, there is shown the mechanism for rotationally displacing rollers 38, 40, 42 and 44 in order to achieve a corresponding counter rotation of barrel 12. Motor 90, which may be manually actuated, is mounted securely to base frame 50 as is shown in FIG. 3. Endless belt 92 passes around drive shaft motor 90 and actuates gear box 94 in rotational displacement. Gear box 94 may be a pulley like mechanism having different troughs of varying diameter to provide a specific output rotation responsive to the drive rotation of motor 90. On an opposing longitudinal end of gear box 94 there is provided sprocket member 96, only shown in FIG. 4, which is driven from shaft 98. It will be noted that shaft member 98 passes in longitudinal direction 32 across the entire width of improved paint sprayer 10 in order to provide synchronous rotational driving forces for rollers 38, 40, 42 and 44.

Referring now to FIG. 3, shaft 98 is driven and in turn provides for rotation of a sprocket member 96 similar to that shown in FIG. 4. Sprocket 96 matingly engages sprocket chains 100 and 102 within opposing housing frames 34 and 36 respectively. Chain 100 passes in mating interface with gear members 104 and 106 secured to shafts 108 and 110 of rollers 40 and 44. Similarly, chain member 102 responsive to the rotational driving force of sprocket member 96 passes in an endless manner around gear members 112 and 114 secured to shafts 116 and 118 defining the shaft extension members of rollers 38 and 42 respectively.

Thus, by rotational drive of motor 90, rollers 38, 40, 42 and 44 are responsively driven in a coincident rotational direction through actuation of shaft 98 in cooperation with chain members 100 and 102 passing around associated gear driven members 104, 106 and 112, 114. As shown in FIG. 2, barrels 12 lie in interfacing contact with opposing rollers 38, 42 and 40, 44. Rotation of rollers 38, 42, 40 and 44 provide for a counter rotation of barrel 12 through a fixed stationary zone defined by the spray emitted through spray nozzles 28.

As shown in FIG. 3, however, not important to the invention as is herein described, there is provided tension idler 120 which may be used to increase or decrease the tension within sprocket chains 100 in the event that some play is found within the entire drive mechanism.

Spray nozzles 28 are mounted to elongated frame members 122 which are fixedly secured to base frame 50 in the manner shown in FIGS. 3 and 4. Paint is passed through conduit 124 which passes in longitudinal extended direction 32. Nozzles 28 intersect conduit 124 at an inclined upward angle as is shown in the figures and provides for an opening wherein the paint passing through conduit 124 under high pressure may be injected into the appropriate barrel zones 14, 16, and 18 as defined by the paint shields 60 and 62.

Additionally, end spray units 30 may be vertically adjusted through sleeve members 126 releaseably secured to vertical posts 127 to provide for an appropriate vertical alignment of spray being emitted from units 30 to end walls 24 and 26 of barrels 12. The appropriate vertical adjustment may be made by a set screw passing through sleeve 126 or some like means not important to the inventive concept as is herein described. Paint is passed through conduit 129 under pressure and is emitted through sidewall nozzles 28'. Nozzles 28' may be mounted to unit 30 through a ball joint or Universal mechanism in order to permit angular orientation with respect to specific section areas of end walls 24 and 26 of barrel 12.

Thus, there is provided mechanism whereby the barrels 12 may be provided with uniform coating of paint being sprayed across a lateral surface in delineated color zones 14, 16 and 18 while simultaneously having end walls 24 and 26 sprayed with a coating of paint.

Once barrel 12 painting has been completed, ejection of barrel 12 from paint sprayer 10 is necessitated in order to accomodate the painting of a next consecutive barrel 12 as shown in FIG. 5. Ejection is accomplished through actuation of ejection air cylinders 128 and 130 shown in FIGS. 2 and 5. Air cylinders 128 and 130 are secured to ejector spline shaft 132 through bell crank devices 134 and 136. Ejector spline shaft 132 is rotationally mounted within bearings 138, 140, 142 and 144 which are themselves secured to an outer wall of housing frames 34 and 36 respectively. Partial rotation or rotative displacement of ejector spline shaft 132 causes a vertically directed displacement of ejector frames 146 and 148 which are pivotally mounted to ejector shafts 150 and 152 through angled mounting extension 154 and 156. As is seen in FIG. 5, angled mounting extension member 154 is pivotally connected to vertical ejector shaft 146 at pivot member 158 and extension 154 is rigidly secured to ejector shaft 150 on an opposing end thereof.

Thus, upward movement of vertical ejector shaft 146 causes a corresponding rotative displacement of ejector shaft 150. Both of ejector shafts 150 and 152 are mounted to walls of housing frames 34 and 36 through rotative bearings 160, 162 and 164, 166 as is shown in FIG. 2. Extending in a lateral direction from shafts 150 and 152, more clearly seen in FIG. 5 relating to shaft 150, there is provided ejector arms 168, 170 which are rotatively displaced responsive to rotation of ejector shafts 150 and 152. Ejector arms 168, 170 terminate in ejector cones 172, and 174 shown in FIG. 1.

Thus, in operation, air cylinders 128 and 130 are actuated to provide downward vertical displacement of piston rods 176 and 178 respectively. Piston rods 176 and 178 are pivotally connected to bell crank devices 134 and 136 which are secured to ejector spline shaft 132. Through this motion, shaft 132 is rotatively displaced and forces vertical ejector shafts 146, 148 in a corresponding downward path. Angled mounting extensions 154 and 156 are secured to ejector shafts 150 and 152 respectively on one end and are pivotally mounted to vertical ejector shafts 146 and 148 on an opposing ends thereof. Thus, vertical movement of ejector shafts 146 and 148 have a corresponding rotary motion transferred to ejector shafts 150 and 152. Ejector arms 168 and 170 fixedly secured and mounted on the ends of shafts 150 and 152 pass in a transverse direction and have a somewhat V-shaped contour.

Rotary motion of shafts 150 and 152 provide for a corresponding rotary motion of ejector arms 168 and 170. Ejector arms 168 and 170 terminate in ejector cones 172 and 174 which are maintained beneath barrels 12 which are being painted. Upon actuation of air cylinders 128 and 130, there is a resultant rotary force applied to the bottom section of barrels 12 to move them away from the improved paint sprayer 10 as is clearly shown in FIG. 5.

Barrels 12 may be guided into appropriate alignment with rollers 38, 40, 42 and 44 through guide members 180 and 182 as is shown in FIG. 1. Guide members 180 and 182 may be V-shaped elements secured to extension members on housing frames 34 and 36. Similarly, barrels which are being ejected from improved sprayer 10 are ejected through egress guide members 184, 186 for maintaining the barrels 12 in proper alignment as they are ejected.

Referring now to FIGS. 1 and 2, there are shown a pair of paint shield members or shield plates 188, 190 extending in longitudinal direction 32 from the sidewalls of housing members 34 and 36. Shield plates 188, 190 pass in a transverse direction and are fastened to housing sidewalls through welding or some like technique. Shield plates 188 and 190 prevent paint from contaminating eject shaft 132 and other components located below shields 188 and 190. An additional plate, not shown, may be mounted on an upper surface of plates 188 and 190 to cover the open space therebetween thereby protecting machine elements from paint overspray and further increasing reliability and operation life of improved paint sprayer 10.

Figure 6:
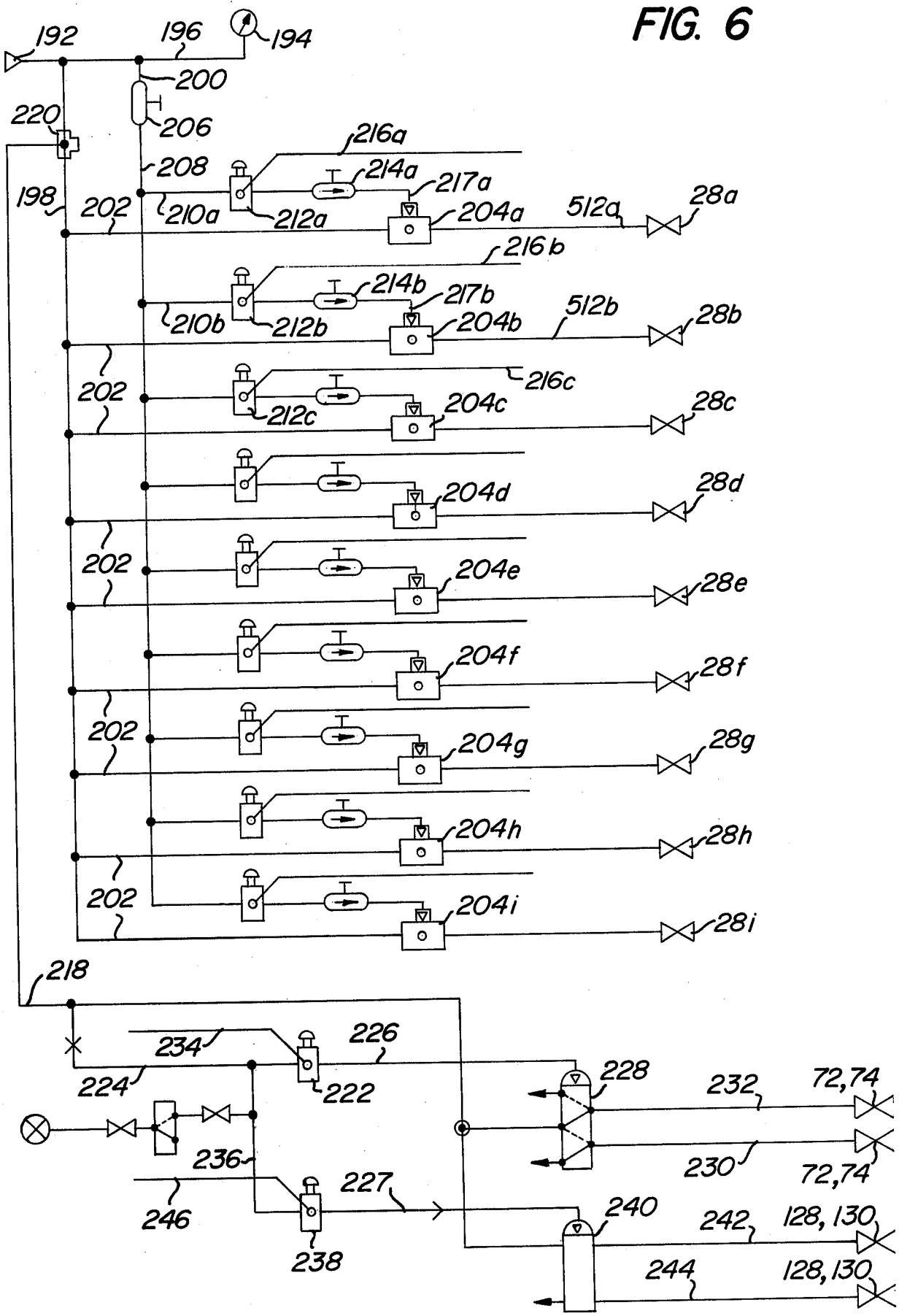

Referring now to FIG. 6, there is shown a schematic diagram relating to air drive for nozzles 28*a–i* as well as shields 60 and 62 and barrel ejection mechanisms. Initially, air under pressure is brought to air panel member 192 where the line pressure is measured by pressure gauge 194 on line 196.

Air from panel member 192 is directed through parallel lines 198 and 200 from line 196. Line 198 is the main air supply conduit to each of nozzles 28*a–i*. Air from line 198 is passed through lines 202 which are coupled to nozzles 28*a–i* through pilot operated valves 204*a–i* respectively.

Manual valve 206 is a two way on/off valve which either permits air flow through line 208 or terminates the flow of air therethrough. When valve 206 is in an "on" position, air flows through line 208 to lines 210*a–i* and then into pushbutton valves 212*a–i*. Since each of the sets of lines and devices after lines 210*a–i* is similar, only the first set will be described in detail.

Depression of pushbutton valve 212*a* permits flow of air to manual on-off control valve 214*a*. When control valve 214*a* is open, air passes into line 217*a* and activates threeway valve 204*a*. Once valve 204*a* is activated, the supply pressure on line 202 is allowed to pass through valve 204*a* and exit through line 512*a* which would then activate piston needles (not shown) thereby forcing paint through nozzle 28*a*.

Air taken from line 196 into line 200 represents passage to a test circuit to allow the operator to depress pushbutton valve 212*a* for manual control of air flow through line 512*a* if a malfunction is suspected. Thus, each of nozzles 28*a–i* may be operated independent of the other in this mode of operation.

Flow of air is terminated through line 208, and a control air signal is passed on line 216*a* from a conventional control system (not shown) through pushbutton valve 212*a* to pilot valve 204*a*. After actuation of pilot valve 204*a*, air flows through line 202 to valve 204*a* and through line 512*a* to nozzle 28*a*.

Air is supplied from line 198 through line 218 and then through a T-section conduit. A control air signal is provided on line 234 which passes through pushbutton valve 222 and then through line 226 to the pilot of a fourway control valve 228. Air is continuously passing from valve 228 through line 232 which is the down cylinder line keeping shields 60, 62 in a down position. However, upon actuation of valve 228 air is removed from line 232 and applied to line 230 which operating through air cylinders 72, 74 drives shields 60, 62 to an up position adjacent barrels 12 on improved sprayer 10. Air is maintained on line 230 until there is a change in a control system line 234 signal which changes the state of pilot operated valve 228 forcing air through line 232.

A control air signal on line 246 passes through pushbutton valve 238 and then through line 227 to thereby activate four way valve 240. Air normally passes on line 242 which is the eject down line. Activation of valve 240 results in removal of air from line 240 and applying air to line 244 results in air cylinders 218 and 130 being activated to eject barrel 12 from sprayer 10.

When the control signal on line 246 is removed, valve 240 is shifted, applying air to line 242 and removing air from line 244 to bring the eject arms to their down position out of contact with barrels 12.

What is claimed is:

1. A paint machine for painting an object, comprising:

(a) a pair of longitudinally displaceable housing means for positionally mounting said object on said paint machine in a predetermined location; each of said housing means having at least one individual and separate rotatable shaft and connecting roller for rotatably driving said object about a longitudinally extending axis of said object, (b) means for spraying paint on an outer surface of said object;

(c) each of said housing means having an individual means for delineating zones on said object surface for directing said sprayed paint from said spray paint means to a predetermined zone on said surface of said object;

(d) housing displacement means for longitudinally displacing said housing means each with respect to the other to accommodate differing sized objects; and (e) means for ejecting said object from said positional mounting on said housing members subsequent to a painting operation.

2. The paint machine as recited in claim 1 in which said ejecting means includes an individual and separate ejection member for each of said housing members, said ejection members being coupled together only through a slideable coupling device for permitting longitudinal displacement of said ejection members upon longitudinal displacement of said housing members by said housing displacement means.

3. The paint machine as recited in claim 2 where said spray paint means includes at least one object end surface spray nozzle mounted to at least one of said displaceable housing members for spraying paint to an end surface of said object.

4. The paint machine as recited in claim 2 in which each of said ejection members has an individual and separate shaft to provide uniform ejection of said object.

5. The paint machine as recited in claim 4 in which said coupling device comprises an ejector spline shaft connected to said ejection members to permit said longitudinal displacement of said ejection members.

6. The paint machine as recited in claim 1 including object alignment means mounted to each of said housing members for positioning said object in said predetermined location with respect to said spray paint means.

7. The paint machine as recited in claim 6 where said object alignment means contacts said object in moveable relation thereto substantially on opposing longitudinal ends of said object.

8. The paint machine as recited in claim 6 where said object alignment means includes object rotation means for rotationally driving said object about a longitudinally extending axis of said object.

9. The paint machine as recited in claim 8 where said object rotation means includes at least a pair of longitudinally displaced rollers coupled to said housing members, said rollers being rotationally driven with respect to said housing members.

10. The paint machine as recited in claim 1 where said spray paint means includes at least one lateral surface spray nozzle mounted to a base frame of said paint machine, said spray nozzle being positionally located for spraying paint to a predetermined zone on a lateral surface of said object.

11. The paint machine as recited in claim 1 where each of said means for delineating zones includes shield means adapted to be positioned adjacent a lateral external surface of said object during said painting operation.

12. The paint machine as recited in claim 11 where each said shield means intercepts spray paint from said spray paint means passing from one of said zones to another of said zones.

13. The paint machine as recited in claim 11 each said shield means is contoured in a manner substantially coincident with a contour of said lateral external surface of said object.

14. The paint machine as recited in claim 11 where each said shield means includes longitudinal actuation means secured to a respective one of said housing means for longitudinally displacing said shield means in accordance with said object being painted and independent of the position of said housing means.

15. The paint machine as recited in claim 14 where each said shield means includes partial rotation means for rotating said shield means (1) into adjacent relation with said lateral external surface of said object, and (2) away from said object subsequent to said painting operation.

16. The paint machine as recited in claim 1 where said means for ejecting said object includes ejection roller members positionally located below said mounted object and adapted to be moveably actuated for contacting a lower surface of said object and displacing said object from said positional mounting.

17. The paint machine as recited in claim 16 where said ejection means includes ejection roller actuation means secured to at least one of said housing members for rotating said roller members into contact with said object lower surface.

18. The paint machine as recited in claim 17 where said ejection roller actuation means includes:

(a) ejection pneumatic air means rotationally secured to an ejection shaft;

(b) bell crank means secured to said ejection shaft on one end and to a roller shaft coupled to said ejection roller members for transferring linear motion of said ejection pneumatic air means to a rotary motion of said roller members.

19. A paint machine for painting an object, comprising:

(a) a pair of longitudinally displaceable housing members for positionally mounting said object on said paint machine in a predetermined location;

(b) means for spraying paint on an outer surface of said object;

(c) means for delineating zones on said surface for directing said sprayed paint from said spray paint means to a predetermined zone on said surface of said object; and, (d) means for ejecting said object from said positional mounting on said housing members subsequent to a painting operation, said ejecting means including ejection roller members positionally located below said mounted object and adapted to be moveably actuated for contacting a lower surface of said object and displacing said object from said positional mounting.

20. The paint machine as recited in claim 19 where said ejection means includes ejection roller actuation means secured to at least one of said housing members for rotating said roller members into contact with said object lower surface.

21. A paint machine for painting an object, comprising:

(a) a pair of longitudinally displaceable housing members for positionally mounting said object on said paint machine in a predetermined location;

(b) means for spraying paint on an outer surface of said object;

(c) means for ejecting said object from said positional mounting on said housing members subsequent to a painting operation, and (d) shield means adapted to be positioned adjacent a lateral external surface of said object during said painting operation, said shield means being displaceably mounted to at least one of said housing members, said shield means including longitudinal actuation means secured to said housing member for longitudinally displacing said shield means in a reversible manner with respect to said object being painted.

22. The paint machine as recited in claim 21 in which said shield means includes partial rotation means for rotating said shield means (1) into adjacent relation with said object and (2) away from said object subsequent to said painting operation.

* * * * *